US006123220A

United States Patent [19]

Williams

[11] Patent Number: 6,123,220

[45] Date of Patent: Sep. 26, 2000

[54] BEVERAGE CONTAINER HOLDER

[76] Inventor: Mark Williams, 22833 Bothell-Everett Hwy., #1277, Bothell, Wash. 98012

[21] Appl. No.: 09/234,086

[22] Filed: Jan. 19, 1999

Related U.S. Application Data

[60] Provisional application No. 60/096,859, Aug. 18, 1998.

[51] Int. Cl.[7] ..... B65D 25/24

[52] U.S. Cl. ..... 220/737; 220/738; 220/630; 248/346.1

[58] Field of Search ..... 248/346.1; 220/737, 220/738, 630, 903

[56] References Cited

U.S. PATENT DOCUMENTS

| | | | |
|---|---|---|---|
| D. 357,388 | 4/1995 | Gaffin | D7/625 |
| 2,652,703 | 9/1953 | Keegan | 248/346.1 |
| 2,688,858 | 9/1954 | Cosmetto . | |
| 2,910,264 | 10/1959 | Lindenberger . | |
| 2,932,119 | 4/1960 | Borah | 248/346.1 |
| 2,968,888 | 1/1961 | Borah . | |
| 3,101,567 | 8/1963 | Stiller | 248/346.1 |
| 4,759,525 | 7/1988 | Cross et al. | 248/346.1 |
| 4,760,987 | 8/1988 | Lan | 248/346.11 |
| 4,955,493 | 9/1990 | Touzani | 215/372 |
| 5,180,132 | 1/1993 | Pearson | 248/362 |
| 5,660,292 | 8/1997 | Scholfield | 220/212.5 |
| 5,711,501 | 1/1998 | Belokin et al. | 248/205.9 |

*Primary Examiner*—Stephen Castellano
*Attorney, Agent, or Firm*—Dean A. Craine

[57] ABSTRACT

A beverage container holder designed to be used in a motor vehicle which includes a body capable of receiving a beverage container. The body includes a top opening and a closed base. In different embodiments disclosed herein, the body is cylindrical or rectangular in shape. The body may be integrally formed or selectively attachable to the base. Formed evenly across the bottom surface of the base is a plurality of mini suction cups. During use, the mini suction cups apply sufficient suction to a flat surface in the motor vehicle to securely hold the holder with a beverage container inserted therein to the flat surface during normal driving conditions.

13 Claims, 2 Drawing Sheets

BEVERAGE CONTAINER HOLDER

This is a Utility Patent Application based on a provisional patent application filed on Aug. 8, 1998 (Ser. No. 60/096,859).

BACKGROUND OF THE INVENTION

1. Field of the Invention

This invention relates to beverage container holders and, more particularly, to beverage container holders designed to be used in a moving vehicle.

2. Description of the Related Art

Most people find it desirable to consume a beverage from a beverage container while riding in a motor vehicle. It would be ideal for the beverage container to be placed into a holder that temporarily attaches to a flat surface in the motor vehicle. The holder must sufficiently attach to the flat, smooth or porous surface to overcome normal forces exerted on the holder while holding a beverage container as the motor vehicle is moving.

What is needed is a beverage container holder capable of temporarily and yet securely attaching to a flat surface in the motor vehicle that holds a beverage container inserted therein in an upright position under normal driving conditions.

SUMMARY OF THE INVENTION

It is an object of the present invention to provide a beverage container holder.

It is another object of the invention to provide a beverage container holder designed to be attached to a flat surface in a motor vehicle.

It is a further object of the invention to provide a beverage container holder that temporarily yet securely attaches to a smooth or porous flat surface in the motor vehicle to hold a container placed therein to be continuously disposed in an upright position under normal driving conditions.

These and other objects are met by the beverage container holder disclosed herein which includes an upward extending body capable of receiving a beverage container. In one embodiment, the body is cylindrical and includes a top opening, outward angled, upward extending side walls attached to a lower, perpendicularly aligned, circular base. A top opening provides access to a longitudinally aligned central cavity formed inside the body. In one embodiment, the central cavity has a sufficient diameter so that a standard aluminum can may be longitudinally aligned and closely fitted therein. The side walls are also sufficient in height to keep the beverage container in an upright position when placed inside the holder and to collect spillage.

In another embodiment, the body is selectively attachable to the base so that different shaped bodies used with the base may hold different shaped beverage containers. Formed on the bottom surface of the base is a plurality of evenly spaced apart mini suction cups. During use, the mini suction cups apply sufficient suction on the flat surface to securely hold the holder with a beverage container inserted therein to the flat surface under normal driving conditions. By forming a plurality of mini suction cups on the base, the holder remains securely attached to the flat surface even when some of the mini suction cups lose their suction.

DESCRIPTION OF THE PREFERRED EMBODIMENT(S)

Figure 1:
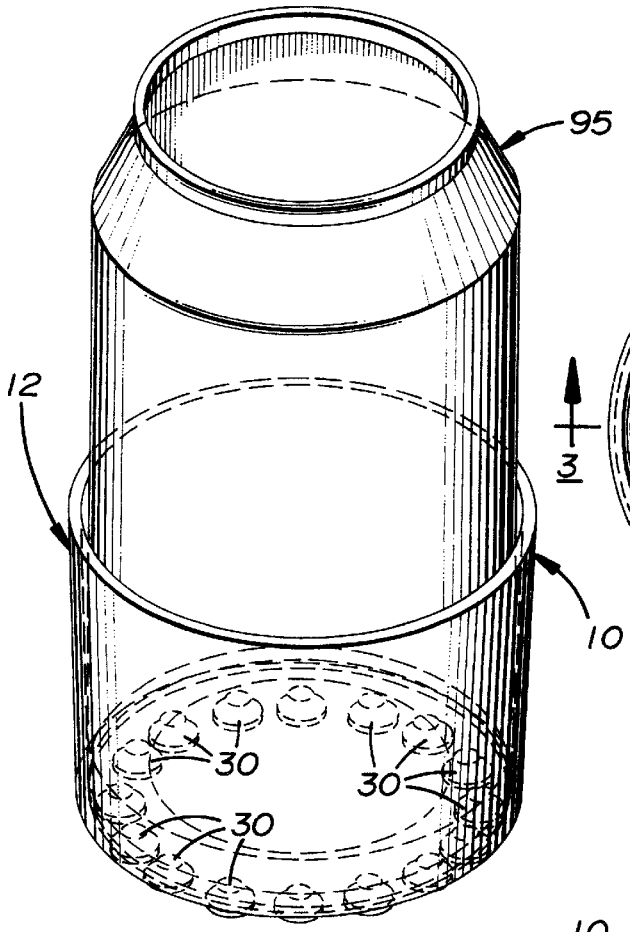
FIG. 1 is a perspective view of the beverage container holder with a can beverage container inserted therein.
Figure 2:
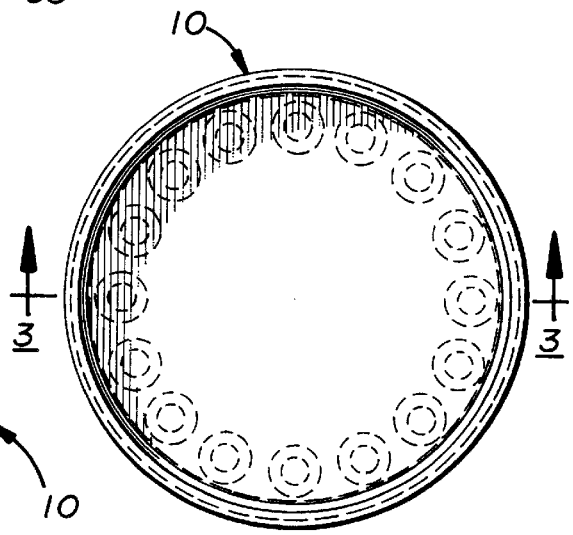
FIG. 2 is a top plan view of the beverage container holder.

As shown in the accompanying Figs., a multiple suction cup beverage container holder, generally referred to as 10, is disclosed. In the first embodiment, shown in FIGS. 1–4, the holder 10 comprises a cylindrical-shaped body 12 capable of receiving a standard size aluminum can beverage container 95. The body 12 includes a top opening 14, longitudinally aligned side walls 16 integrally attached to a lower, perpendicularly aligned base 20. The top opening 14 provides access to a longitudinally aligned central cavity 18 having a sufficient diameter to closely hold a standard aluminum can beverage container 95 placed therein. The side walls 16 extend upward and slightly outward from the base 20 and have sufficient height to maintain spillage and to keep the container 95 in an upright position when placed inside the holder 10.

Figure 5:
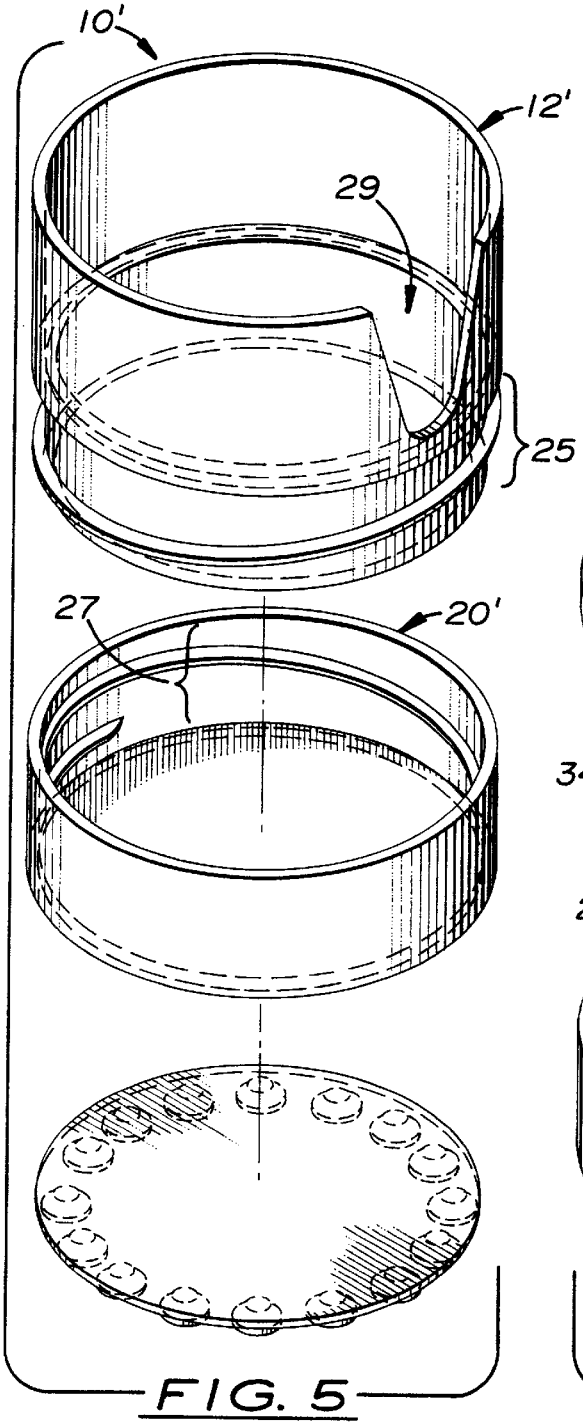
FIG. 5 is an exploded, perspective view of another embodiment of the beverage container holder in which the cylindrical body is selectively attached to the base.
Figure 6:
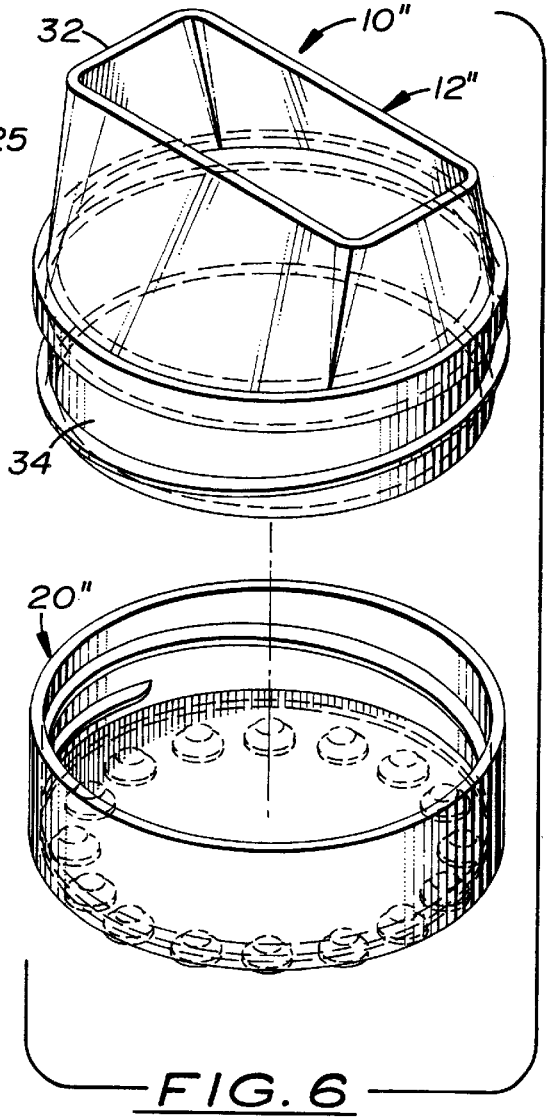
FIG. 6 is an exploded perspective view of another embodiment of the beverage container holder similar to the holder shown in FIG. 5 which uses a rectangular shaped body.

Shown in FIGS. 5 and 6 are second and third embodiments of the holder 10', 10", respectively. The second embodiment of the holder 10' includes a cylindrical body 12' which selectively attaches to a cylindrical base 20'. An attachment means is disposed between the body 12' and base 20' which enable them to be selectively attached together. In the embodiment shown, the attachment means includes external threads 25 formed on the lower, outside surface of the body 12' and internal threads 27 formed on the inside surface of the base 20' capable of being interconnected. The body 12' may include an optional, vertical aligned slot 29 capable of receiving a handle on the container.

The third embodiment of the holder 10" is similar to the second embodiment with the body 12' including an upper rectangular portion 32 and a lower cylindrical portion 34. The upper portion 32 is designed to receive the body 12", which may be integrally formed with the base 20" or may include threads 25 and 27 so that the body 12" and base 20" may be selectively attached together.

Figure 3:
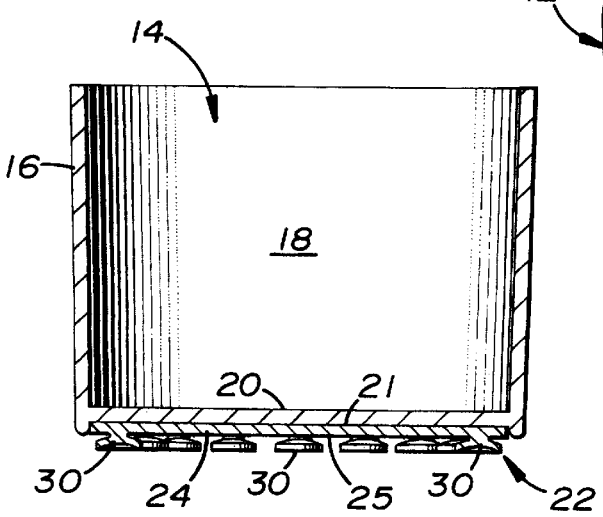
FIG. 3 is a side elevational view of the beverage container holder as seen along line 3—3 in FIG. 2.
Figure 4:
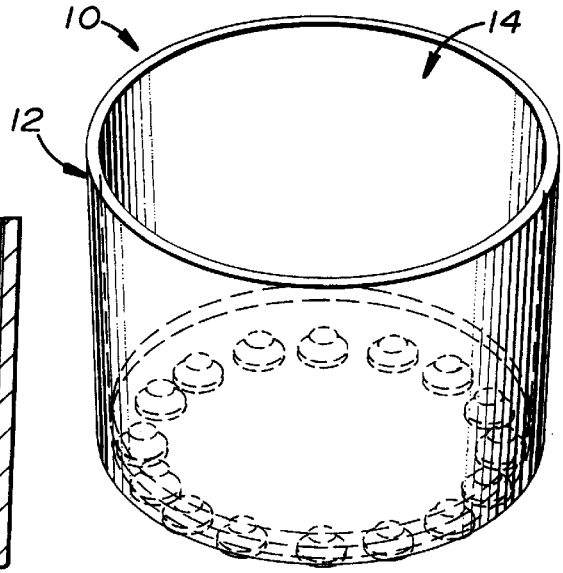
FIG. 4 is a perspective view of the beverage container holder and suction cups.

Referring to FIG. 3, the bottom surface 21 of each base (only base 20 shown) is recessed thereby creating a receiving space 22 for a plate 24. Formed on the bottom surface 25 of the plate 24 is a plurality of evenly spaced apart mini suction cups 30. During use, the mini suction cups 30 apply sufficient suction on the flat surface to securely hold the holder 10 with a beverage container 95 inserted therein to the flat surface under normal driving conditions. By using a plurality of mini suction cups 30, the holder 10 remains securely attached to the surface even when some of the mini suction cups lose their suction.

In the preferred embodiment, the bodies 12, 12', 12" are made of polystyrene. The lower portion of each body 12, 12', 12" is approximately 3 inches in diameter while the upper portion of the bodies 12, 12' is approximately 3.5 inches in diameter. The upper portion of the body 12" measures approximately 1.5×2.75 inches (W×L). Since a typical aluminum can beverage container 95 is approximately 2.75 inches in diameter, a 0.05 inch space is created between the inside surface of the side wall 16 and the outer surface of the beverage container 95. The side walls 16 measure 1 to 2 inches in height and 0.06 to 0.08 inches in thickness.

The plate 24 and mini suction cups 30 are made of rubber or silicone material. Each mini suction cup 30 is approximately 0.12 inch in height and 0.28 inch in diameter. The plate 24 is approximately 2.75 inches in diameter and 0.075 inches thick. A suitable adhesive is used to attach the plate 24 into the bottom surface 21 of each base 20, 20', 20". In the embodiment shown in the accompanying Figs., there are eighteen mini suction cups 30 evenly spaced apart and radially aligned on the bottom surface 25 of the plate 24. It should be understood that the number, size and alignment of the mini suction cups 30 on the plate 24, however, can vary. The minimum number of mini suction cups 30 is three, which must be evenly distributed on the bottom surface 25 in order for the invention to operate correctly.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A beverage container holder comprising:

a. a body having surrounding side walls, a longitudinally aligned central cavity, a top opening, and a perpendicularly aligned lower base, said lower base having a bottom surface with a receiving space formed therein;

b. a plate disposed inside said receiving space of said lower surface; and, c. a plurality of mini suction cups evenly spaced apart over said plate.

2. A beverage container holder as recited in claim 1, wherein said mini suction cups are radially aligned over said plate.

3. A beverage container holder, as recited in claim 1 wherein said body is cylindrical and approximately 3 inches in diameter and said side walls extend upward approximately 3½ inches from said lower base.

4. A beverage container holder, as recited in claim 1, wherein said plate is adhesively attached to said receiving space.

5. A beverage container holder, as recited in claim 4, further including said body being made of polystyrene.

6. A beverage container holder, as recited in claim 4, further including said suction cups being made of silicone.

7. A beverage container holder, as recited in claim 3, wherein said body includes a longitudinally aligned slot formed on said body capable of receiving a handle formed on a container when placed inside said holder.

8. A beverage container holder, as recited in claim 1, wherein said body and said base are integrally formed together.

9. A beverage container holder as recited in claim 1, wherein said body is rectangular.

10. A beverage container holder, as recited in claim 1, further including an attachment means disposed between said body and said base enabling said body and base to be selectively attached together.

11. A beverage container holder, as recited in claim 10 further including a longitudinally aligned slot capable of receiving a handle formed on a container when placed inside said container.

12. A beverage container holder as recited in claim 10 wherein said body is rectangular.

13. A beverage container holder as recited in claim 10 wherein said attachment means is a pair of threads formed on said body and said base capable of being selectively interconnected to selectively attach said body and said base together.

* * * * *